US010292499B1

(12) United States Patent
Liu

(10) Patent No.: US 10,292,499 B1
(45) Date of Patent: May 21, 2019

(54) CHAIR STRUCTURE

(71) Applicant: Huang Chang Liu, Changhua County (TW)

(72) Inventor: Huang Chang Liu, Changhua County (TW)

( * ) Notice: Subject to any disclaimer, the term of this patent is extended or adjusted under 35 U.S.C. 154(b) by 0 days.

(21) Appl. No.: 15/812,100

(22) Filed: Nov. 14, 2017

(51) Int. Cl.
*A47C 7/44* (2006.01)

(52) U.S. Cl.
CPC ..... *A47C 7/445* (2013.01)

(58) Field of Classification Search
CPC ..... A47C 7/443; A47C 7/40; A47C 3/04
See application file for complete search history.

(56) References Cited

U.S. PATENT DOCUMENTS 5,123,702 A * 6/1992 Caruso ..... A47C 3/04 297/239
5,868,468 A * 2/1999 Wang ..... A47C 3/04 297/239
2002/0060492 A1* 5/2002 Nagamitsu ..... A47C 7/40 297/452.18
2004/0075316 A1* 4/2004 Ballendat ..... A47C 3/04 297/239
2005/0012371 A1* 1/2005 Mendenhall ..... A47C 1/124 297/248
2005/0161990 A1* 7/2005 Piretti ..... A47C 7/44 297/285
2011/0062754 A1* 3/2011 Mills ..... A47C 3/04 297/188.08
2011/0266843 A1* 11/2011 Gamboa ..... A47C 3/04 297/188.14
2012/0299350 A1* 11/2012 Willingham ..... A47C 3/12 297/284.2
2016/0143443 A1* 5/2016 Roslund, Jr. ..... A47C 7/44 297/299
2016/0255960 A1* 9/2016 Piretti ..... A47C 5/06

* cited by examiner

*Primary Examiner* — Gary C Hoge
(74) *Attorney, Agent, or Firm* — Muncy, Geissler, Olds & Lowe, P.C.

(57) ABSTRACT

A chair structure contains: a seat, a back plate one-piece formed with the seat, and an upright frame locked on a bottom of the seat. The back plate includes a convex face formed on a front end thereof, multiple slots separately defined in the back plate, and multiple flexible sheets arranged on a rear end of the back plate. The multiple flexible sheets have different thicknesses individually, wherein a thickness of a central one of the multiple flexible sheets adjacent to the back plate is less than another flexible sheets proximate to the central flexible sheet, and the other flexible sheets close to two sides of the back plate are thicker than said another flexible sheets. Furthermore, the multiple slots accommodate a plurality of reinforcement ribs respectively.

4 Claims, 3 Drawing Sheets

CHAIR STRUCTURE

FIELD OF THE INVENTION

The present invention relates to a chair structure which covers user's back so as to adjust sitting position, to support user's waist, and to decrease user's waist and back pressure.

BACKGROUND OF THE INVENTION

A conventional chair is made of plastic material and contains a seat and a back plate one-piece formed with the seat. Alternatively, the conventional chair contains a seat and a back plate movably connected with the seat.

However, the chair has following defects:

1. When the seat is movably connected with the back plate, an upright frame made of metal material is connected with a bottom of the seat, thus having complicated manufacture process and high production cost.

2. When the seat is one-piece formed with the back plate, the back plate is hard so as to support user's back, thus having using discomfort.

3. The back plate has an inflexible face which does not deform, so it cannot support user's wrist sufficiently.

The present invention has arisen to mitigate and/or obviate the afore-described disadvantages.

SUMMARY OF THE INVENTION

The primary aspect of the present invention is to provide a chair structure which the multiple flexible sheets do deform when user back contacts with the back plate so as to cover and support greatly so as to matingly cover the user's back, thus adjusting sitting position, supporting user's waist, and decreasing user's waist and back pressure.

To obtain above-mentioned aspect, a chair structure provided by the present invention contains: a seat, a back plate one-piece formed with the seat, and an upright frame locked on a bottom of the seat.

The back plate includes a convex face formed on a front end thereof, multiple slots separately defined in the back plate, and multiple flexible sheets arranged on a rear end of the back plate. The multiple flexible sheets have different thicknesses individually, wherein a thickness of a central one of the multiple flexible sheets adjacent to the back plate is less than another flexible sheets proximate to the central flexible sheet, and the other flexible sheets close to two sides of the back plate are thicker than said another flexible sheets.

Furthermore, the multiple slots accommodate a plurality of reinforcement ribs respectively.

DETAILED DESCRIPTION OF THE PREFERRED EMBODIMENTS

Figure 1:
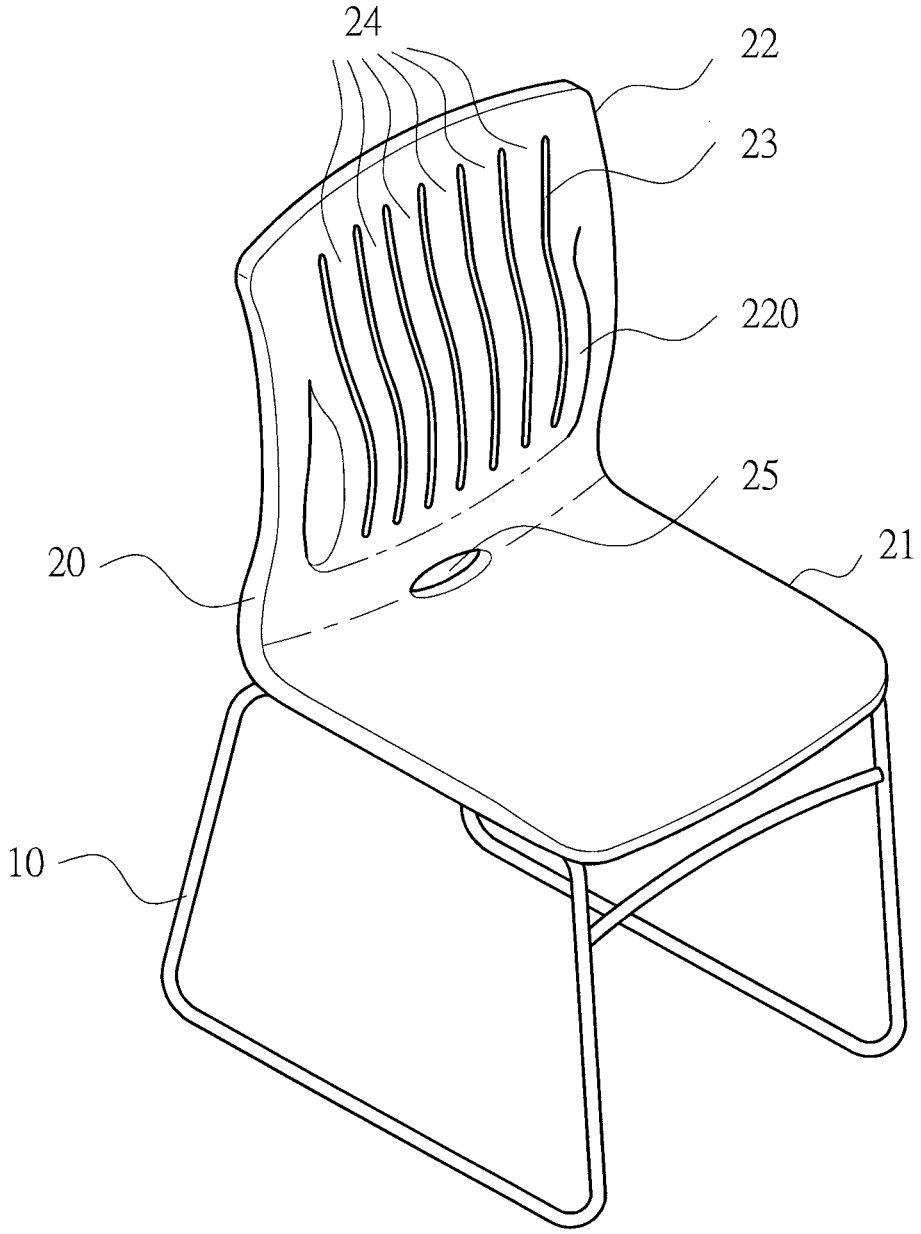
FIG. 1 is a perspective view showing the assembly of a chair structure according to a preferred embodiment of the present invention.
Figure 2:
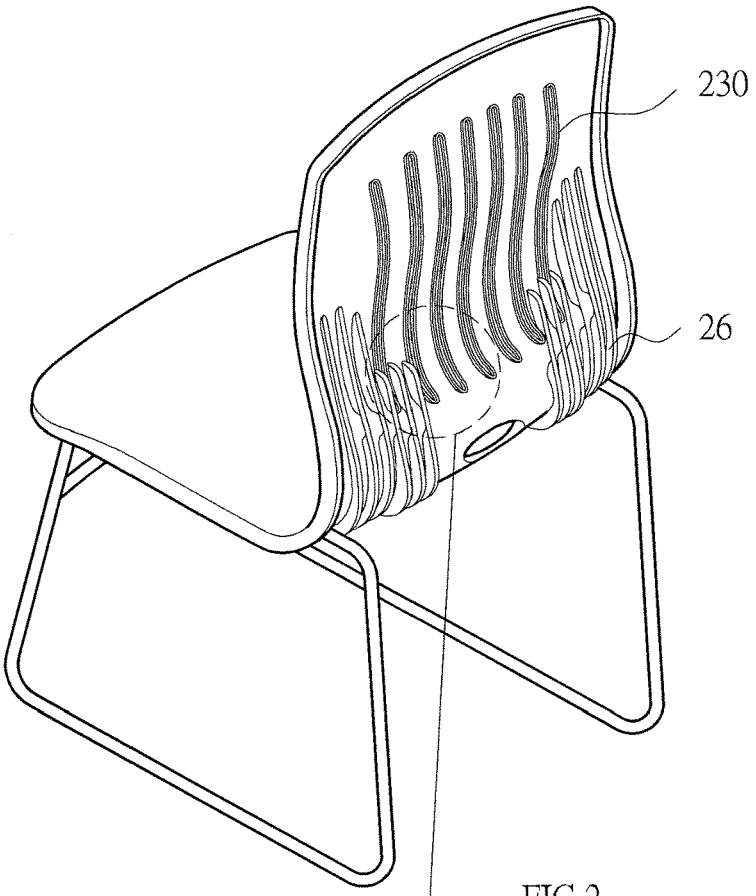
FIG. 2 is another perspective view showing the assembly of the chair structure according to the preferred embodiment of the present invention.
Figure 3:
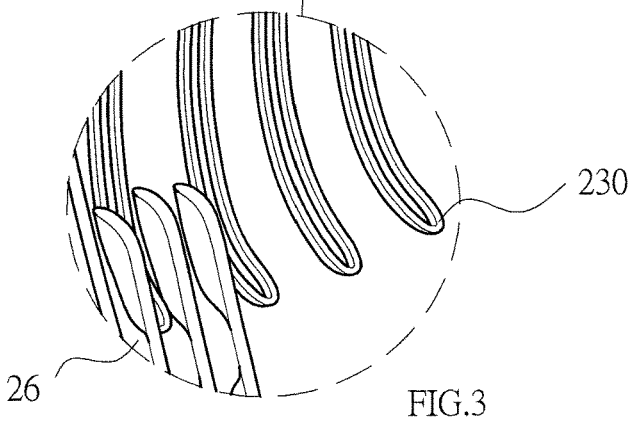
FIG. 3 is a perspective view showing the assembly of a part of the chair structure according to the preferred embodiment of the present invention.

With reference to FIGS. 1-3, a chair structure according to a preferred embodiment of the present invention comprises: a seat 21 and a back plate 22 one-piece formed with the seat 21. The back plate 22 includes a convex face 220 formed on a front end thereof, multiple slots 23 separately defined in the back plate, multiple flexible sheets 24 arranged on a rear end of the back plate 22, wherein the multiple slots 23 accommodate a plurality of reinforcement ribs 230 respectively, and an air orifice 25 is defined on a connection portion of the back plate 22 and the seat 21 so as to enhance air permeability, wherein multiple support ribs 26 are arranged on a connection of the seat 21 and the rear end of the back plate 22 so as to enhance support of the back plate 22.

Figure 4:
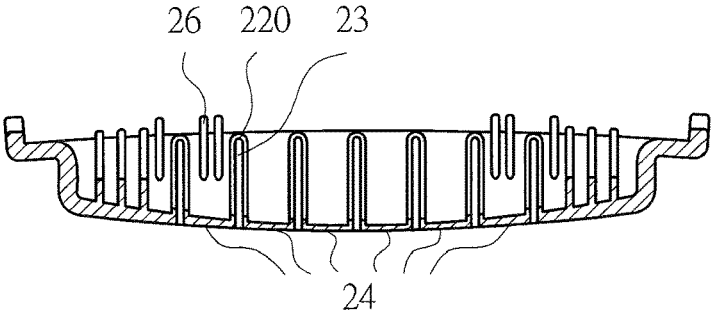
FIG. 4 is a cross sectional view showing the assembly of a part of the chair structure according to the preferred embodiment of the present invention.

With reference to FIG. 4, the multiple flexible sheets 24 have different thicknesses individually, wherein a thickness of a central one of the multiple flexible sheets 24 adjacent to the back plate 22 is less than another flexible sheets 24 proximate to the central flexible sheet 24, and the other flexible sheets 24 close to two sides of the back plate 22 are thicker than said another flexible sheets 24, hence the back plate 22 deforms flexibly.

In addition, an upright frame 10 is locked on a bottom of the seat 21.

Accordingly, the chair structure of the present invention has advantages as follows:

1. The plurality of reinforcement ribs 230 are accommodated in the multiple slots 23 respectively so as to enhance reinforcement of the multiple flexible sheets 24.

2. The convex face 220 of the back plate 22 matingly contacts with user's back, so addition supporting cushion or pillow is not required.

Figure 5:
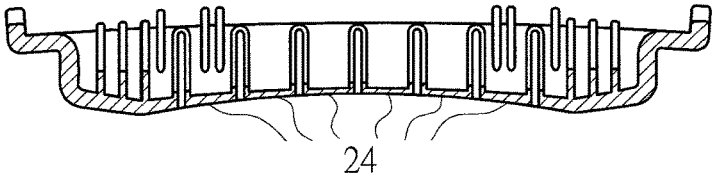
FIG. 5 is another cross sectional view showing the assembly of a part of the chair structure according to the preferred embodiment of the present invention.

3. As shown in FIG. 5, the multiple flexible sheets 24 have different thickness individually, wherein a thickness of a central one of the multiple flexible sheets 24 adjacent to the back plate 22 is less than another flexible sheets 24 proximate to the central flexible sheet 24, and the other flexible sheets 24 close to two sides of the back plate 22 are thicker than said another flexible sheets 24, hence the back plate 22 deforms flexibly. When the user's back contacts with the back plate 22, the multiple flexible sheets 24 deform greatly so as to matingly cover the user's back, thus enhancing support and using comfort.

Figure 6:
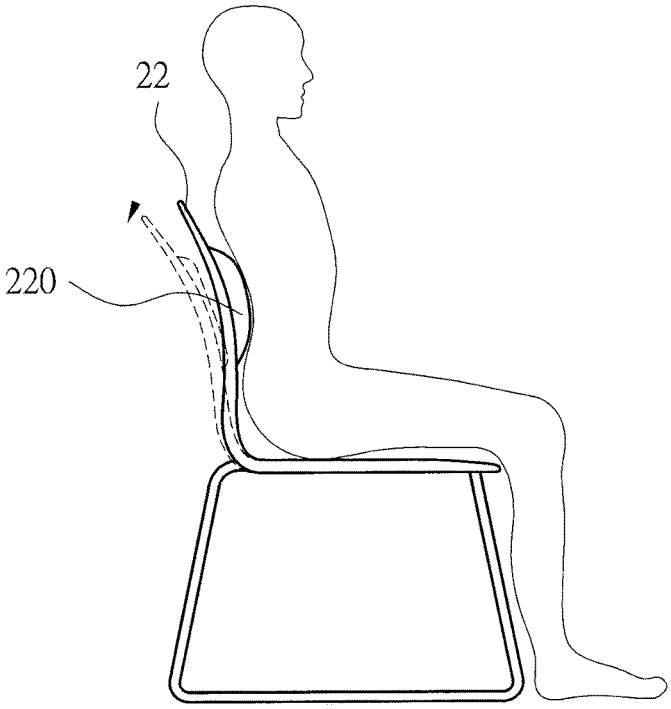
FIG. 6 is a side plan view showing the application of the chair structure according to the preferred embodiment of the present invention.

4. Referring to FIG. 6, when the user's back contacts with the back plate 22, the back plate 22 moves backward slightly so that the user contacts with the back plate 22 comfortably. Preferably, the multiple support ribs 26 reinforce the back plate 22 so as to support the back plate 22 forcefully.

5. The seat 21 is one-piece formed with the back plate 22, and the multiple slots 23 cover the user's back so as to simplify manufacture process and to reduce fabrication cost greatly.

What is claimed is:

1. A chair structure comprising:

a seat and a back plate one-piece formed with the seat;

the back plate including a convex face formed on a front end of the back plate, multiple slots separately defined in the back plate, and multiple flexible sheets arranged on a rear end of the back plate;

wherein the multiple flexible sheets have different thicknesses individually, wherein a thickness of a central one of the multiple flexible sheets is less than another flexible sheets proximate to the central flexible sheet, and other flexible sheets close to two sides of the back plate are thicker than said another flexible sheets, such that the multiple flexible sheets are progressively thicker from the center flexible sheet outward to vary a thickness of a part of the seat;

wherein the multiple slots accommodate a plurality of reinforcement ribs respectively; and an upright frame locked on a bottom of the seat.

2. The chair structure as claimed in claim 1, wherein multiple support ribs are arranged on a connection of the seat and the rear end of the back plate.

3. The chair structure as claimed in claim 1, wherein an air orifice is defined on a connection portion of the back plate and the seat.

4. The chair structure as claimed in claim 2, wherein an air orifice is defined on a connection portion of the back plate and the seat.

* * * * *